United States Patent [19]

Crosslen

[11] Patent Number: 4,673,090

[45] Date of Patent: Jun. 16, 1987

[54] MODULAR EXPANDABLE MERCHANDISE DISPLAY RACK

[75] Inventor: Louis J. Crosslen, Saukville, Wis.

[73] Assignee: Frank Mayer & Associates, Grafton, Wis.

[21] Appl. No.: 851,971

[22] Filed: Apr. 14, 1986

[51] Int. Cl.[4] ..... A47F 5/00

[52] U.S. Cl. ..... 211/183; 211/78; 211/131; 16/355; 16/382

[58] Field of Search ..... 211/189, 163, 144, 131, 211/133, 183, 78; 16/355, 356, 382

[56] References Cited

U.S. PATENT DOCUMENTS

| | | | |
|---|---|---|---|
| 3,931,894 | 1/1976 | Murphy | 211/189 |
| 3,942,647 | 3/1974 | Crosslen | 211/131 X |
| 3,957,159 | 5/1976 | Radek | 211/131 X |
| 4,140,223 | 2/1979 | Rau et al. | 211/131 X |
| 4,247,010 | 1/1981 | Eckert | 211/131 |
| 4,531,645 | 7/1985 | Tisbo et al. | 211/131 |

*Primary Examiner*—John E. Murtagh
*Assistant Examiner*—Naoko N. Slack
*Attorney, Agent, or Firm*—James E. Nilles; Nicholas A. Kees

[57] ABSTRACT

A multi-sided merchandise display rack comprises a horizontally disposed base means, a plurality of module side brackets, each pair defining a hinge removably supported by the base means, and display means connected between adjacent side brackets. The side brackets include tube means of C-shaped cross section tapped at the bottom such that screws may be inserted through the base means and threaded into the tapped inner tubes.

12 Claims, 13 Drawing Figures

MODULAR EXPANDABLE MERCHANDISE DISPLAY RACK

BACKGROUND OF THE INVENTION

This invention relates to retail merchandise display devices, and in particular to such devices which are used for merchandising cigarettes which devices are easily expandable onsite and are modular in construction.

There are many devices available for displaying cigarette packs and cartons for retail sale, although all such previous devices had certain disadvantages. For example, U.S. Pat. No. 3,942,647, invented by the inventor of the present application and assigned to the same assignee as is this application, shows a display rack having an internal "spider" support structure. The device there disclosed has several disadvantages. First, the spider support structure effectively prevents any expansion of the device such as by increasing the number of sides of the unit. Second, the plastic shelf units are disclosed to be onepiece units, effectively preventing the rearrangement of portions thereof to allow different displays of items, such as accessories and whole cartons, to be intermingled with the pack displays.

Another example is U.S. Pat. No. 3,820,862, again having the same inventor and assignee, wherein a display rack having theft-proof features is disclosed. This display device again is supported from within mainly by a center shaft, which limits the possibilities for expansion.

The present invention is directed toward improvements over the devices described above and solutions to the problems raised thereby.

SUMMARY OF THE INVENTION

The invention provides a display rack for display of cigarette packs, cartons and accessory items, which display rack is easily expandable while the display is in the store. In addition the display is modular, allowing the operator to arrange various types of display modules, such as for cartons, single packs, gravity feeds for packs and accessory racks in any manner desired, and to rearrange the different types of modules easily when such may be desirable. The invention includes a lower disk which is swivelably attached to a base plate which, in turn, rests on the floor or on casters. The lower disk, and an identical upper disk, each have a plurality of sets of holes formed about the periphery thereof. Each set of holes is spaced equally about the periphery of each disk, and will accommodate a like number of bolts or pins inserted therein. Each of these bolts or pins attaches to one of a pair of module side brackets, the second one of the pair being pivotably attached to the first. Each of these second module side brackets is slidable onto and off of the first one of any particular pair. Each one of these module side brackets is disposed vertically and runs the length of the display rack. Each also cooperates with the opposite member of the next pair to hold a plurality of display modules, which, in turn, hold the cigarette packs or other items to be displayed and offered for sale in the rack. The rack is then expanded by removing the pins or bolts holding the brackets, sliding one of the module side bracket pairs apart, moving the brackets outward to the next set of holes, sliding in another set of module side brackets, and reattaching the brackets to the upper and lower disks. Each of the module side brackets is provided with a threaded channel which runs its length. Each module then has the same height and width dimensions, the width dimension being such that the module spans the distance from one pair of module side brackets to the next. The idea of the invention is that at least several of the modules will be held along the length of the rack. The depth dimension of the particular module depends upon the type of module. For instance the depth of a module for holding whole unopened cartons may be the length of a carton while the depth of a module for holding opened cartons or individual packs may be the length of a single pack. A gravity feed module is provided which pushes at least the bottom one of a column of items out to facilitate the selection of the bottom item and to allow the next higher item to slide down into the place formerly occupied by the selected item. The invention also includes individual items display modules and accessory display modules.

It is thus an object of the invention to provide a display rack for the retail sale of cigarettes and associated accessories or other retail items which can be expanded easily in the store by simply adding to the number of sides of the rack.

Another object of the invention is to provide a display rack as described above wherein the display rack comprises modules which can be arranged and rearranged according to the needs of the particular establishment using the rack.

Still another object of the invention is to provide a display rack as described above wherein the means of attaching the modules to the rack is such that racks of different sizes and different functions may be attached in any desired arrangement on the rack, for improved flexibility.

A more specific object of the invention is to provide a display rack as described above wherein at least one of the modules is a gravity feed module which pushes at least the bottom one of a column of items out to facilitate the selection of the bottom item and to allow the next higher item to slide down into the place formerly occupied by the selected item.

Other objects and advantages of the invention will become apparent hereinafter.

DESCRIPTION OF THE PREFERRED EMBODIMENTS

Figure 1:
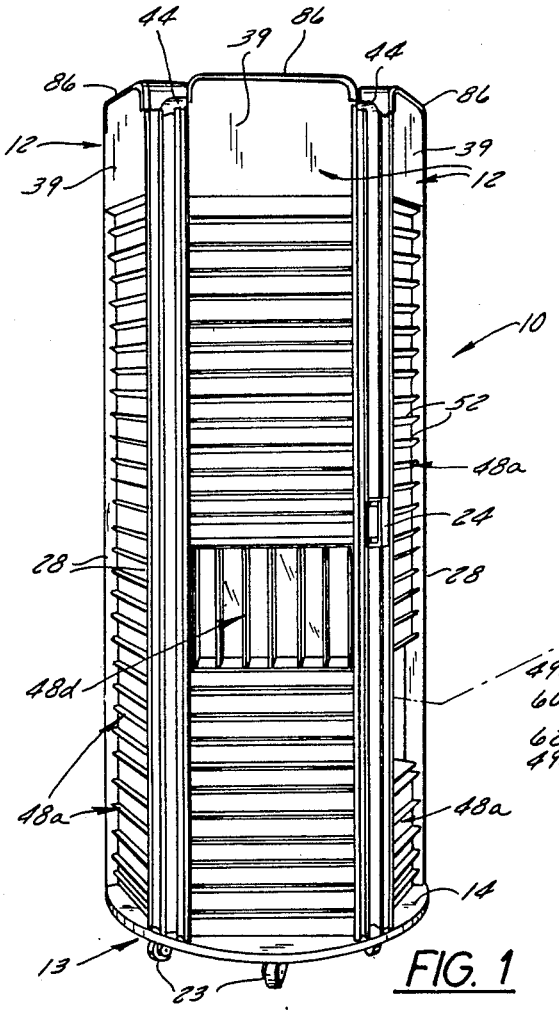
FIG. 1 is an isometric view, partially exploded and partially cut away, of, a display rack constructed according to the present invention.
Figure 2:
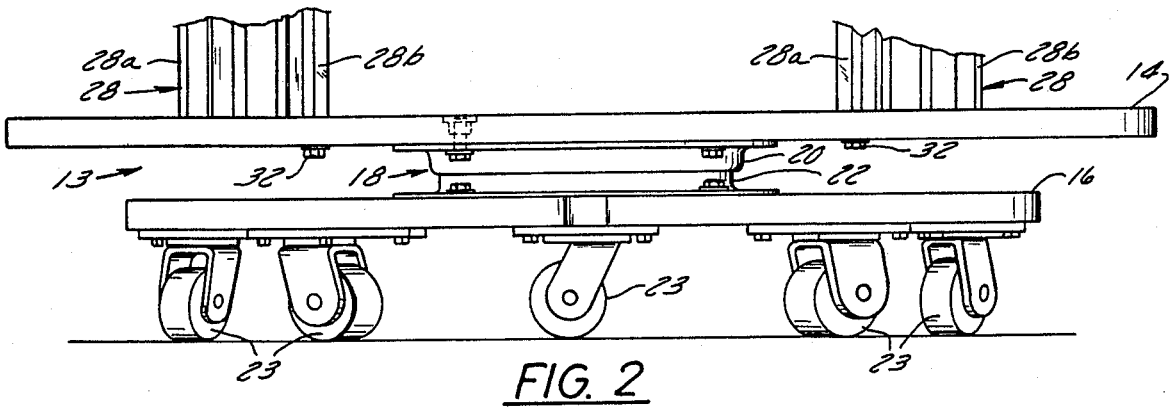
FIG. 2 is an enlarged fragmentary view of the base portion of the display rack shown in FIG. 1.

Referring now to FIG. 1, there is shown an isometric view of the merchandise display rack 10 of the present invention. As shown therein, a plurality of sides 12 of shelf units rest upon a generally horizontally disposed base means 13. As shown in more detail in FIG. 2, base means 13 includes a horizontal bottom disk 14 which is connected to and rests on a horizontal base plate 16 by means of a slew ring assembly 18. This slew ring assembly 18 includes an upper ring 20 secured to the underside of bottom disk 14, rotatably mounted on a lower ring 22, which is, in turn, secured to the facing side of base plate 16. Bottom disk 14 is thus allowed to rotate freely in either direction about a generally vertical axis with respect to base plate 16 by means of slew ring assembly 18. Swivelably attached to the underside of base plate 16 are preferably a plurality of casters 23 to assist in moving the rack 10 from place to place on a floor. Referring again to FIG. 1, a handle 24 may also be supplied to further assist in moving the rack 10. An upper support member 25, having the proper number of sides to correspond with the rack 10, is attached at the top of sides 12 to provide further support and stability.

Figure 3A:
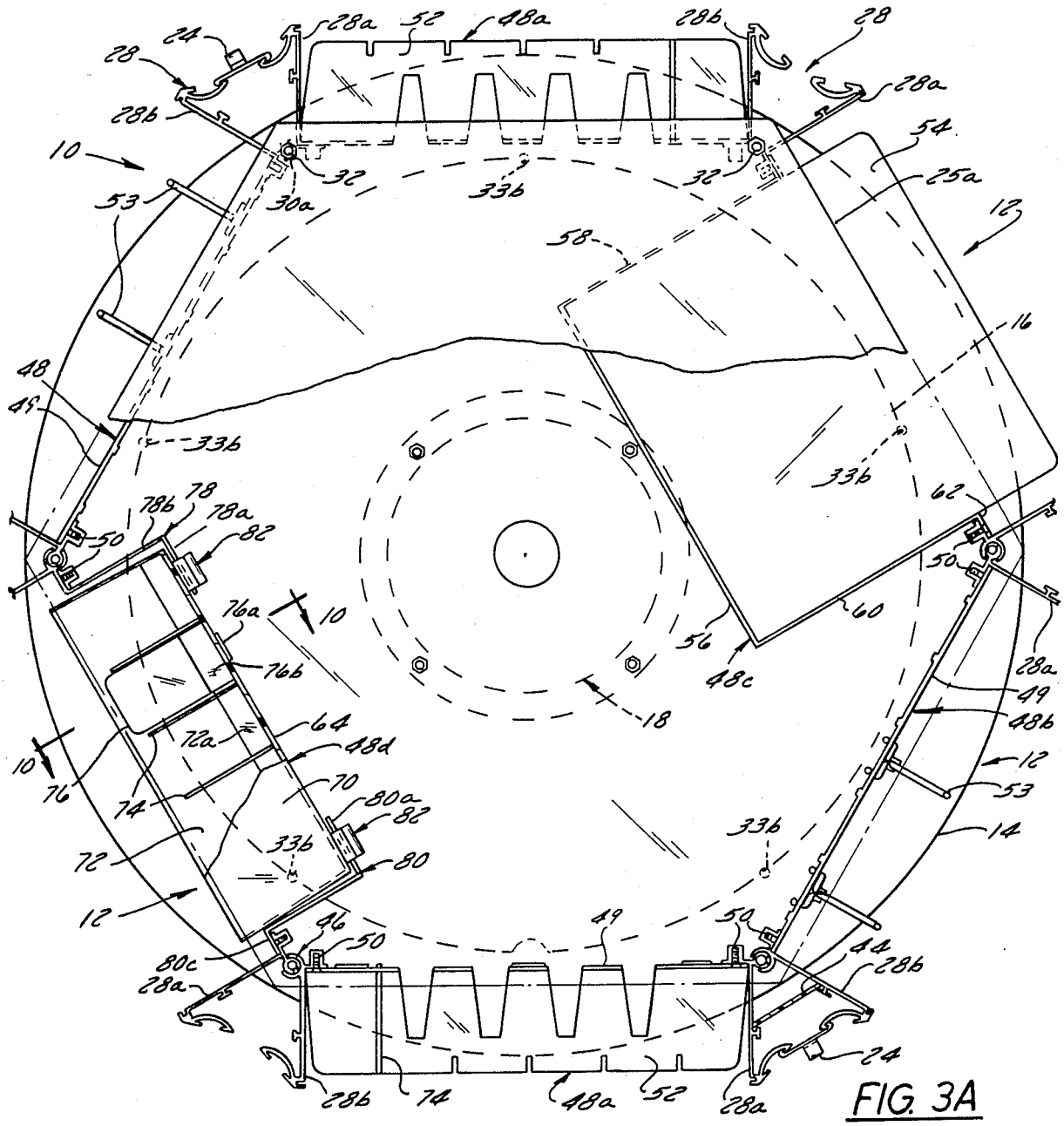
FIG. 3A is a top view of a display rack constructed according to the present invention, having certain parts cut away for clarity, and having six sides.
Figure 3B:
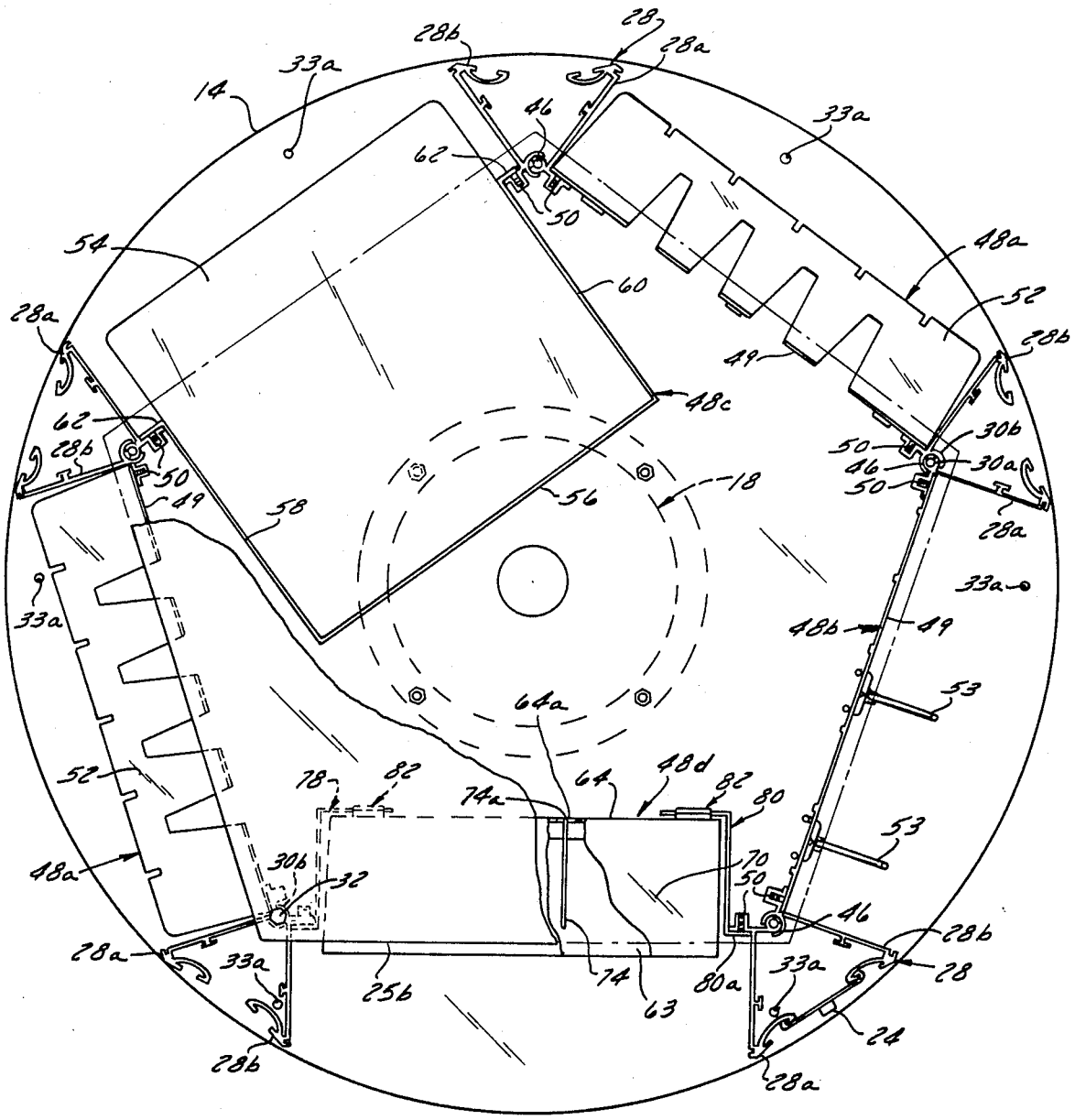
FIG. 3B is a top view similar to the rack shown in FIG. 3A except having five sides.
Figure 4:
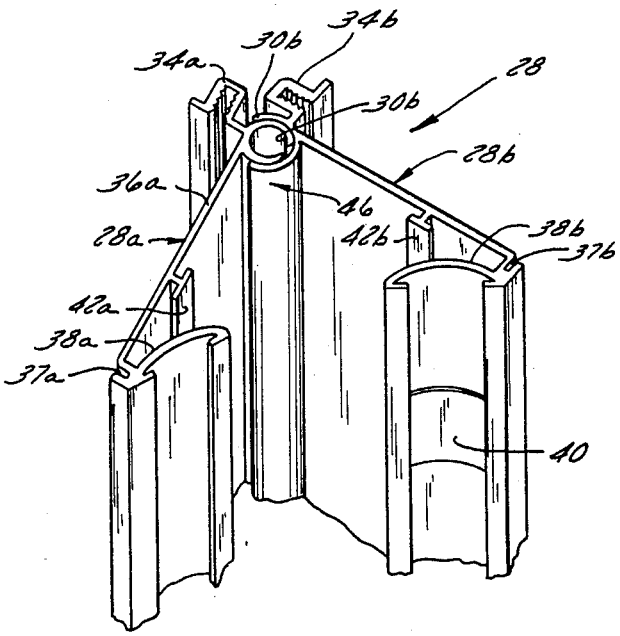
FIG. 4 is an enlarged isometric view of an assembled pair of module side brackets employed in one preferred embodiment of the invention.

FIGS. 3A and 3B are top views of the rack 10, partially cut away for clarity, showing two different configurations of the same embodiment of the invention. FIG. 3A shows a six-sided configuration of the rack 10, while FIG. 3B shows a five-sided configuration. As can be seen in these drawing figures, each side 12 of rack 10 comprises any one or more of a plurality of different modules 48, each supported by two module side brackets 28. As shown in FIG. 1, these module side brackets 28 are arranged vertically parallel and spaced equally about the periphery of the bottom disk 14, and extending generally upward co-extensive with the height of the rack 10. Module side brackets 28 can be seen in more detail by comparing FIGS. 3A and 3B with FIGS. 4 and 5. As shown in those figures, there are actually two such brackets, a left bracket 28*a* and a right bracket 28*b* which are approximately mirror images of each other. Each such bracket has a tube 30*a* and 30*b* running the length thereof, which tubes are C-shaped in cross-section and sized relative to each other so that the tube 30*b* of left bracket 28*a* engages and slides lengthwise over the tube 30*a* of right bracket 28*b*. Thus in the embodiment shown, the tube 30*a* is slidable inside the other tube 30*b*. The module side brackets 28*a* and 28*b* preferably have a cross section that is uniform all along their lengths so as to be suitable for production as an extrusion.

Figure 5:
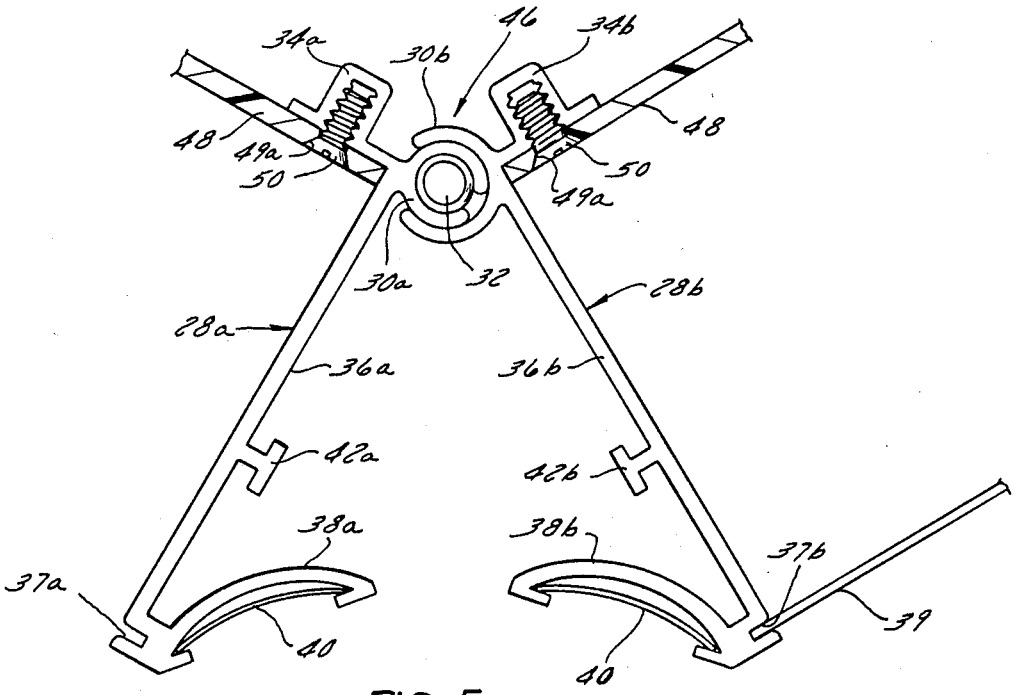
FIG. 5 is a top view of the module side brackets shown in FIG. 4.
Figure 6:
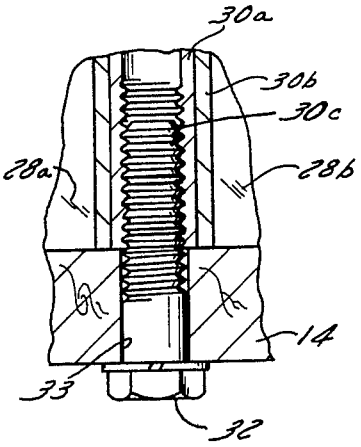
FIG. 6 is a fragmentary sectional view of the bottom disk showing the attachment of the module side brackets thereto.

As shown in FIG. 6, each pair of module side brackets 28*a* and 28*b* is then attached at its bottom to the bottom disk 14 by a screw 32 inserted upward through a hole 33 in the bottom disk 14 and threaded into a threaded portion 30*c* at the bottom end of smaller tube 30*a*. The top end of tube 30*a* (FIGS. 3A and 3B) is attached to upper disk 25 in a similar manner. Referring again to FIGS. 3, 4 and 5, the module side brackets 28*a* and 28*b* also each include a threaded channel 34*a* and 34*b*, respectively, which are attached to or formed integrally with the respective tubes, and co-extensive with the length of the brackets, projecting radially out from the tubes. Projecting radially out edgewise from the tubes at an angle of about 90 degrees to the threaded channels 34*a* and 34*b* are flat panels 36*a* and 36*b*, each of which terminate at their distal ends in concave channels 38*a* and 38*b* which extend laterally inward toward the opposite bracket and are co-extensive with the length of the bracket and tube. The purpose of these channels 38*a* and 38*b* is to hold product identifying information such as trademarks, and possibly pricing information, in the form of cards or tags 40. Also at the distal ends of the flat panels 36*a* and 36*b*, facing opposite concave channels 38*a* and 38*b*, are card channels 37*a* and 37*b*, for holding header cards 39 (also shown in FIG. 1). These header cards 39 are provided to display advertising and pricing information, and to generally improve the appearance of the rack 10. A T-shaped projection 42*a* and 42*b* projects toward each opposite bracket from about the center of the panels 36*a* and 36*b* respectively. The purpose of projections 42*a* and 42*b* is to hold therebetween a trim panel 44 (FIGS. 1, 3A and 3B) so as to further improve the aesthetic appearance of the display rack 10.

The fact that each tube 30*a* is slidable within each tube 30*b* results in a hinge 46 being defined by brackets 28*a* and 28*b* at that point. As shown in FIGS. 3A and 3B, one such hinge 46 exists for each side 12 of the rack 10. This hinge 46 between the two brackets 28*a* and 28*b* is the feature that allows the variability in the number of sides as referred to above. While FIG. 3A shows a configuration having six sides and FIG. 3B shows a configuration having five sides, the number of sides can be any number that can be accommodated by the allowed angle between the brackets 28*a* and 28*b*. Certainly, the range should include from four to nine sides, meaning that the included angle between the brackets ranges from 90 degrees to 40 degrees. The actual maximum included angle will be determined by the relative configuration of the C-shape of the tube 30*b* and the position of the threaded channel 34*a* on tube 30*a*. The actual minimum included angle will be determined either by the relative configuration of the C-shape of the tube 30*b* and the position of the flat panel 36*a* on tube 30*a*, or by the distance between the distal edges of channels 38*a* and 38*b*, whichever results in the greater included angle. A number of different sets of holes 33*a* and 33*b* are provided in bottom disk 14, one such hole in each set for each required hinge. Thus, for instance, there are six holes 33*a* spaced equally about the periphery of disk 14, while there are five holes 33*b* spaced thereabout. The top disk 25*a* (FIG. 3A) is generally flat and polygonal in shape, having the number of sides which corresponds to the current number of sides of rack 10 (in the case of the rack shown in FIG. 3A, six sides). A different top disk 25*b* must be used with the rack shown in FIG. 3B, since it has a five sides. The top disk is preferably polygonal in shape and has the proper number of sides so as to accommodate card holder modules 48*e*, which will be explained in more detail subsequently.

The procedure for adding a side 12, for instance, to change from five sides to six, is to first remove all the screws 32 from the threaded ends of tubes 30*a* and from the holes 33*b*, and remove the top disk 25*b* (FIG. 3B). Then remove one of the sides 12 by sliding it upward. The remaining sides 12 may now be refastened to bottom disk 14 in their new positions by aligning the threaded ends of tubes 30*a* with the respective holes 33*a* and reinserting the applicable screws 32. The removed side and a new side may now be slid into place and fastened there by screws 32. Finally a new top disk 25*a* (FIG. 3A), having the new number of sides, is installed thereon. Similarly, to reduce the number of sides, say, from six to five, the procedure is generally reversed. First the screws 32 are removed from the threaded ends of the tubes 30*a* and from the holes 33*a*, and the top disk 25*a* is removed. Then the side or sides to be removed are taken out by sliding upward, along with one additional side. The four remaining sides 12 may now be re-fastened to bottom disk 14 in their new positions by aligning the threaded bottom ends of tubes 30*a* with the respective holes 33*b* and reinserting the applicable screws 32. Then the one additional side that was removed is reinstalled by sliding it downward onto the tubes of the existing sides and attached there by a screw 32. Finally, a top disk 25*b* with five sides is installed.

In the above discussion and in the claims which follow, the term "side" or "sides" is used to refer to the assembly 12 which includes a right side bracket 28*b* of one bracket pair 28 and a left side bracket 28*a* of an adjacent bracket pair 28, connected by means of one or more of any of a number of different types of display means or display modules 48. About the only limitation on these display modules 48 is that they have the same width dimension, and preferably that they have the same height dimension, or at least that the larger of the modules have a height dimension which is a multiple of the smaller modules. The depth dimension may vary as needed and as allowed by the size of the display rack created by the assembly of the particular number of sides used. As shown in FIGS. 3A, 3B and 5, each of these display modules 48 is attached to the respective two module side brackets 28*a* and 28*b* by screws 50 which are inserted through holes 49*a*, preferably countersunk, provided for that purpose in the modules 48, and threaded into the threaded channels 34*a* and 34*b* of the module side brackets, which threaded channels are capable of receiving one or more screws 50 and holding them at any point along the length of the channels. Since the threaded channels 34*a* and 34*b* run the length of the module side brackets 28*a* and 28*b*, vertical positioning and adjustment of the modules 48 is facilitated.

A number of different display modules 48 are shown in the various drawing figures, although many other types of modules could be used. FIGS. 3A, 3B and 7A show a basic individual item display module 48*a*. This module 48*a* is mainly a flat vertical plate 49 having a number of shelves 52 attached thereto or formed integrally therewith, and extending outward therefrom for support of a predetermined number of items thereon, for display so that the shopper may choose and remove any one or more of the items for purchase. As noted above, countersunk holes 49*a* are provided at the corners for engaging screws 50 for attachment of the module 48*a* to the module side brackets 28*b* and 28*a*.

Figure 7B:
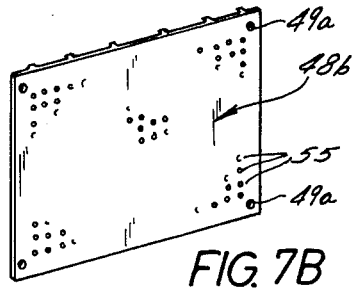
FIG. 7B is an isometric view of another type of module employed in the preferred embodiment of the invention.
Figure 7A:
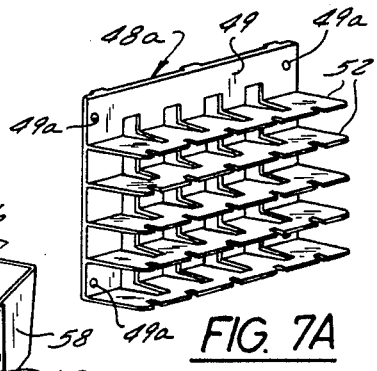
FIG. 7A is an isometric view of one type of module employed in the preferred embodiment of the invention.
Figure 9:
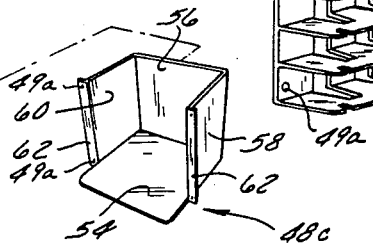
FIG. 9 is an isometric view of the back of the module shown in FIG. 8, as employed in the preferred embodiment of the invention.
Figure 9:
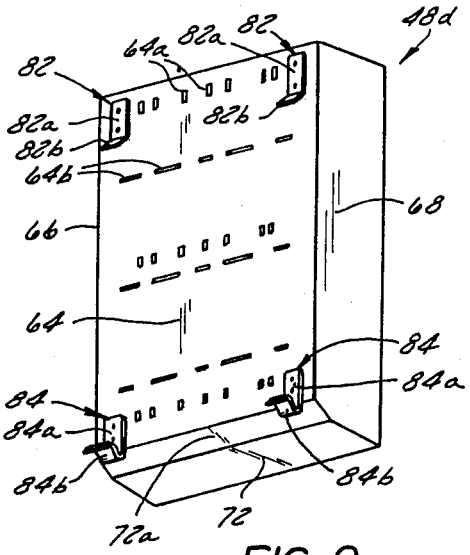
Figure 8:
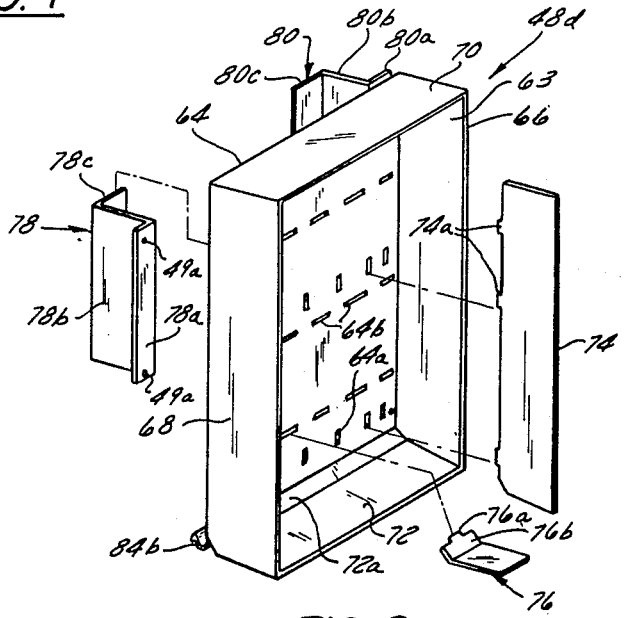
FIG. 8 is an exploded isometric view of yet another type of module employed in the preferred embodiment of the invention.

An accessory display module 48*b* is shown in FIGS. 3A, 3B and 7B. This display module 48*b* is basically flat and plain, having a surface with a large number of perforations 55 for engaging one or more pegboard type hangers 53 (FIGS. 3A and 3B), often called J-hooks. Any type of merchandise, such as cigarette lighters, flints, and so on. Once again, countersunk holes 49*a* are employed near each of the corners for engaging screws 50 for attachment of the module to the module side brackets 28*b* and 28*a*.

FIGS. 1, 3A and 3B show a container display module 48*c*, for display and customer selection of containers of a plurality of individual items, such as whole closed cartons or any other articles too large to fit in the individual items display module 48*a*. This module 48*c* may be sized so as to accommodate cartons placed horizontally endwise therein, the depth dimension thereof then being the length of a whole carton, reaching into the interior of the rack 10 beyond the plane of the two module side brackets 28*b* and 28*a* to which it is attached. As shown in the referenced figures, this module 48*c* includes a substantially flat and plain horizontal support plate 54 which, along with substantially flat and plain vertically disposed back plate 56 and side plates 58 and 60, which are attached thereto or formed integrally therewith, make up a rectangular box having an open front and top. The forward edges of side plates 58 and 60 are each provided with a laterally projecting lip 62, having holes 49*a* at the top and bottom thereof for engaging screws 50 for attachment of the module to the module side brackets 28*b* and 28*a*. As also shown in the figures, the horizontal support plate 54 may project beyond the forward edges of side plates 58 and 60 for added support of the items to be displayed therein.

FIGS. 1, 3A, 3B and 8 through 11 show a gravity feed display module 48*d*, for displaying individual items, such as cigarette packs, as does the individual items display module 48*a*, except that this module 48*d* includes means for allowing the selection by the customer of one or more such individual items from the bottom thereof, and means for allowing other such items to slide down or otherwise move into position and replace the ones taken. The module 48*d* is made up of a rectangular box 63 having a flat back plate 64 connected to or formed integrally with lateral side plates 66 and 68 and top and bottom plates 70 and 72. Bottom plate 72 may have a sloped or inclined portion 72*a* at the back thereof, where it connects to back plate 64, so as to push the bottom item outward just a bit to facilitate its removal by a customer. The module 48*d* will preferably include vertical dividers 74 for subdividing the space inside the box 63 and arranging the items into columns for selection by the customer. The vertical dividers 74 are attached to the back plate 64 by means of tabs 74*a* formed integrally therewith, which snap into vertical slots 64*a* formed in plate 64. Sufficient slots 64*a* may be formed to accommodate several different arrangements of items or different sizes of items by allowing the vertical dividers 74 to be attached thereto with different spaces therebetween. Means may also be provided to facilitate the selection of an item that is not the bottom item and allowing the remaining items to slide down to replace the nonbottom item selected. In the embodiment shown in FIGS. 3A, 8 and 9, these means include one or more horizontal dividers 76. These horizontal dividers 76 have tabs 76*a* at the back thereof which may fit into any of several horizontal slots 64*b* formed in the back plate 64 for engagement therewith. Horizontal dividers 76 may also have a sloped or inclined portion 76*b* at the back thereof. The function of inclined portion is the same as inclined portion 72*a* of bottom plate 72 except that, using dividers 76, more than one item can be pushed out slightly in any one column. Thus horizontal dividers 76 can be used, for instance, to separate different brands of the same type of item in the same column.

Module 48*d* also includes means for removably attaching box 63 to the module side brackets 28*b* and 28*a*, and those attaching means are required to be compatible with the means for attaching the other modules described above. To that end, double-angle mounting brackets 78 and 80 are provided, each being generally vertically disposed and having laterally projecting lips 78*a* and 80*a* at their forward edges, similar to lip 62 of container display module 48*c*, each having the now familiar countersunk holes 49*a* at the top and bottom thereof for engaging screws 50 for attachment of the mounting brackets 78 and 80 to the module side brackets 28*b* and 28*a*. The mounting brackets 78 and 80 also have vertically disposed flat panels 78*b* and 80*b* which reach inward from lips 78*a* and 80*a*, respectively, toward the inner part of the rack 10, and culminate in support ledges 78*c* and 80*c* which angle toward the respective facing mounting bracket 80 and 78. Upper support brackets 82 are attached to the upper back of the back plate 64, while lower support brackets 84 are attached to the lower back of the back plate 64. The upper support brackets 82 may be very simple, having flat portions 82*a* attached by any suitable means, such as bolts, to back plate 64, and angled portion 82*b* which juts back away from plate 64. Somewhat similarly, lower support brackets 84 may have a flat portion 84*a* bolted to back plate 64 and a reverse hook shaped portion 84*b* extending away from the back plate 64.

Figure 11:
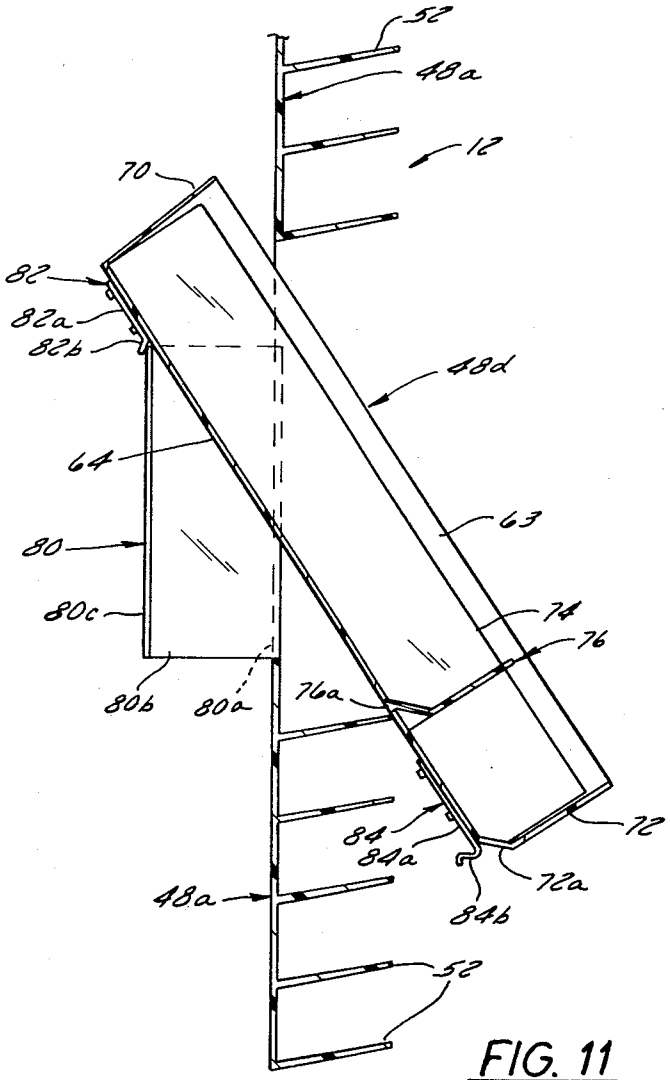
FIG. 11 is a cross-sectional view similar to FIG. 10, except showing the gravity feed module in its loading or restocking position.
Figure 10:
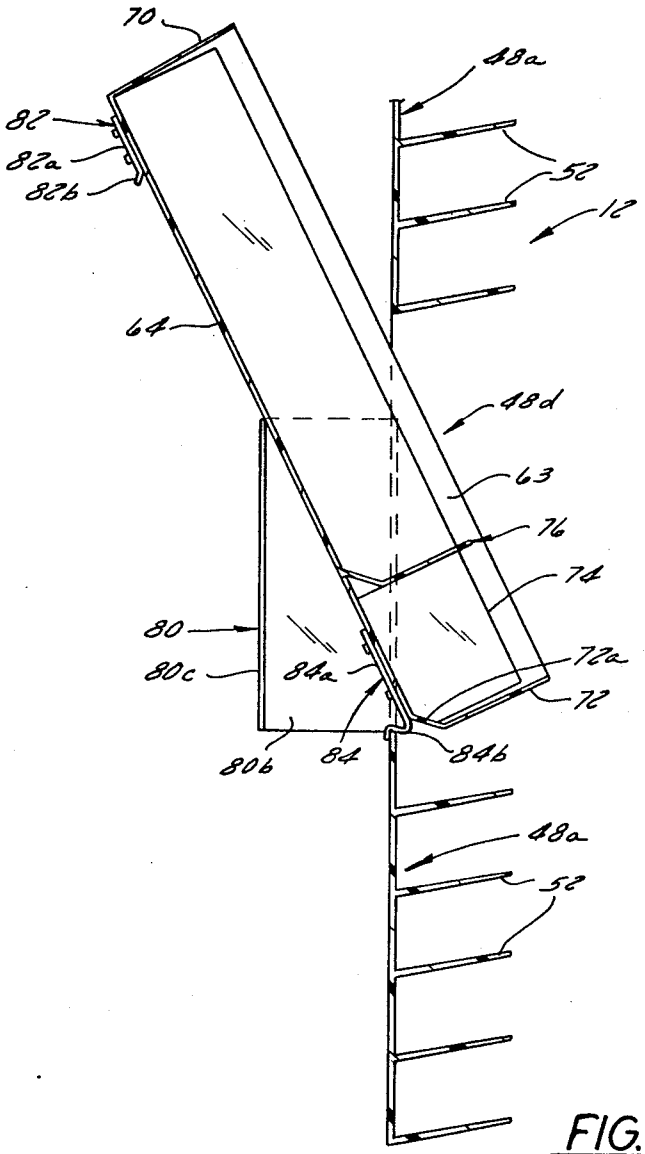
FIG. 10 is a cross-sectional view, taken along line 10—10 of FIG. 3A, showing the gravity feed module in its display position.

The function of these support brackets 82 and 84 in combination with the mounting brackets 78 and 80 is shown in FIGS. 10 and 11. In FIG. 10 the gravity feed module 48*d* is shown in its normal display position. Its weight is supported mainly by lower support brackets 84, the reverse hook portions 84*b* of which, in turn, are resting on the next lower module such as basic module 48*a*. The box 63 of module 48*d* is leaning inward, against the top portion of support ledges 78*c* (FIGS. 8 and 9) and 80*c*. As can be seen, the bottom area of box 63 can easily be accessed by a customer for removal of the bottom one or several items for purchase. The top of box 63 is hidden behind the next higher module 48*a*. This is not a disadvantage since the items are intended to be removed from near the bottom of the box 63 anyway. Further, the height of the box 63 is not limited by the size of the other modules 48, and thus the overall stock capacity of the rack may be increased by use of a number of gravity feed modules 48*d* in rack 10.

FIG. 11 shows the gravity feed module 48*d* in its loading or restocking position. In this position the box 63 and lower support bracket 84 have been lifted off the next lower module 48*a*. The box 63 has then been slid downward and outward until the upper support brackets 82 have caught on the top of support ledges 78*c* (FIGS. 8 and 9) and 80*c*, where the majority of the weight is supported. The back plate 64 of box 63 rests against and partially overlies the next lower module 48*a*. Thus in this position the entire box 63 can be easily accessed to restock and reload items removed therefrom. Since this position will normally only be used for restocking, it is not a real disadvantage that the next lower module 48*a* is partially covered in this position. When the restocking operation is completed, the box 63 is slid upward, with the back plate 64 leaning against the support ledges 78*c* and 80*c* until the lower support brackets 84 can be rested on the next lower module 48*a*. The module 48*d* is thus returned to the display position shown at FIG. 10.

A display card cap 86 rests on top of each display card 39 and on top of each side 12 so as to further enhance the appearance of the assembled rack, add stability and give it a finished appearance. Since the card 39 and cap 86 will generally extend above the top end of the module side brackets 28*a* and 28*b*, and thus above the top disk 25' or 25'', the top disk cannot practically be a round member and still connect to the top ends of the module side brackets. This is the reason that the top disk is preferably polygonal as described above.

While the apparatus hereinbefore described is effectively adapted to fulfill the aforesaid objects, it is to be understood that the invention is not intended to be limited to the particular preferred embodiments of modular expandable merchandise display rack herein set forth. Rather, it is to be taken as including all reasonable equivalents without departing from the scope of the appended claims.

I claim:

1. In a multi-sided merchandise display rack for retail display of items to be selected by a customer, the combination comprising:

a horizontally disposed base means at the bottom thereof;

a plurality of pairs of module side brackets, each said pair defining a hinge removably supported by said base means, arranged horizontally spaced apart about the periphery of said base means, and extending generally upward and approximately co-extensive with the height of said rack, wherein each bracket of each said pair is pivotable and removable with respect to the other bracket of said pair; and display means connected between one module side bracket of one pair and the opposite module side bracket of an adjacent pair to form each side of said rack, such that the number of sides of said rack can be increased and reduced by insertion and removal, respectively, of one or more sides, and such that the remaining sides pivot at said hinge to adjust for said removed and inserted sides;

each of said module side brackets of each pair including tube means having a C-shaped cross section co-extensive therewith and sized so as to engage the tube means of the opposite one of said pair, an inner tube being inside an outer tube, and so as to be slidable lengthwise and pivotable about the center axis of said tube with respect to said opposite one, so as to comprise said hinge;

each of said inner tubes being tapped at least at the bottom thereof, allowing each of said pairs of module side brackets to be attached to said base means by means of screws inserted through said base means and threaded into said tapped inner tubes, thereby providing an attachment of said pairs of module side brackets to said base means.

2. A display rack as recited in claim 1 wherein each of said module side brackets has a threaded slot attached to said tube means, which slot is co-extensive with the length of said tube means and is able to receive one or more screws at any point along its length.

3. A display rack as recited in claim 2 wherein said display means includes a plurality of modules attached to said brackets by means of screws inserted through holes in said modules and threaded into said threaded slots of said brackets.

4. A display rack as recited in claim 3 wherein one or more of said modules is an individual items display module for display of individual items on shelves integrally formed with said module, such that any number of individual items may be selected for purchase by said customer.

5. A display rack as recited in claim 3 wherein one or more of said modules is an accessory display module for displaying items which are of an accessory nature to the rest of the items displayed on said rack, said module being perforated for engagement with one or more pegboard type hangers.

6. A display rack as recited in claim 3 wherein one or more of said modules is a container display module for displaying containers containing a plurality of individual items, such that the whole containers may be selected for purchase by said customer.

7. A display rack as recited in claim 6 wherein the two module side brackets to which the module is attached are parallel and define a plane, and wherein the depth dimension of said container display module reaches into the interior of said rack beyond said plane defined by the two module side brackets to which it is attached.

8. A display rack as recited in claim 3 wherein one or more of said modules is a gravity feed module for displaying individual items including means for facilitating selection of the bottom item thereof and means for allowing the remaining items to move into position replacing any selected items.

9. A display rack as recited in claim 8 wherein said gravity feed module further includes means for facilitating selection of an item that is not the bottom item and means for allowing the remaining items to move into the position formerly occupied by the selected item.

10. A display rack as recited in claim 9 wherein said gravity feed module includes support means for supporting said rack in one of two positions, a restocking position in which the entire module is directly accessible and a display position in which the upper part of the module is located behind the next higher module in said rack.

11. A display rack as recited in claim 1 or claim 4 or claim 5 or claim 7 or claim 10 wherein said base means includes a bottom disk to which the module side brackets are attached and a base plate to which the bottom disk is attached by swivel means, such that said rack is swivelable about a generally vertical axis with respect to said base plate.

12. A display rack as recited in claim 11 wherein said base plate rests on a plurality of swivelable casters for facilitating the moving of said rack from place to place.

* * * * *